US005588385A

United States Patent [19]

Sand

[11] Patent Number: 5,588,385

[45] Date of Patent: Dec. 31, 1996

[54] METHOD FOR MANUFACTURING IMPROVED BACK POCKET BLANK FOR PANTS

[75] Inventor: Edward A. Sand, St. Louis, Mo.

[73] Assignee: Western Textile Products Company, St. Louis, Mo.

[21] Appl. No.: 362,218

[22] Filed: Dec. 22, 1994

[51] Int. Cl.[6] ..... A41D 27/20

[52] U.S. Cl. ..... 112/475.09; 2/247

[58] Field of Search ..... 112/475.09, 475.06; 2/247

[56] References Cited

U.S. PATENT DOCUMENTS

| | | | |
|---|---|---|---|
| 2,825,907 | 3/1958 | Phillips, Jr. | 112/475.09 |
| 3,137,865 | 6/1964 | Evans et al. | 2/247 |
| 4,156,293 | 5/1979 | Off | 2/247 |
| 4,263,678 | 4/1981 | Off | 2/247 |
| 4,316,756 | 2/1982 | Wilson | 2/247 X |
| 4,321,710 | 3/1982 | Off | 2/247 |
| 4,365,355 | 12/1982 | Off et al. | 2/247 |
| 4,549,916 | 10/1985 | Off et al. | 156/93 |
| 4,553,269 | 11/1985 | Nowak | 2/254 |
| 4,656,673 | 4/1987 | Easton et al. | 2/247 |
| 4,845,784 | 7/1989 | Shirinian | 2/253 |

*Primary Examiner*—Paul C. Lewis

*Attorney, Agent, or Firm*—Polster, Lieder, Woodruff & Lucchesi LC

[57] ABSTRACT

A method for manufacturing an improved back pocket blank for pants is disclosed. The method includes the forming of an elongated generally rectangular shaped back pocket blank to provide a flattened longitudinally side edge folded over section on each side of the back pocket blank with a transverse fold of the entire back pocket blank positioning flattened longitudinal side edge folded over sections of transversely folded over and non-folded over areas in superimposed relationship to one another, the transverse fold being creased in order to maintain the transversely folded over area in proximity to the non-folded area of the back pocket blank. A small area of each of the superimposed flattened longitudinal side edge sections on each side of the back pocket blank can be at least temporarily secured to one another to assist in maintaining the respected folded position. This may be accomplished by an adhesive, fusing, sonic or sewing attachment, as may be desired.

15 Claims, 2 Drawing Sheets

METHOD FOR MANUFACTURING IMPROVED BACK POCKET BLANK FOR PANTS

BACKGROUND OF THE INVENTION

The present invention relates to a method of forming back pocket blanks for attachment to pants within a back pocket opening, and to the back pocket blank itself.

Pockets are necessary components of garments for carrying a variety of useful articles, as is well known. In the manufacture of pockets for pants, a pocket blank is typically supplied by a specialized manufacturer who manufactures and supplies large quantities of pocket blanks to a pants manufacturer. Piece work employees of the pants manufacturers sew the pocket blanks into pocket shapes while also then sewing the formed pockets into a pocket opening of pants.

In the manufacture of back pocket blanks for the back pockets of pants, the specialized manufacture of pocket blanks typically produces separate back pocket blanks by longitudinally folding the edges of a strip of material into a flattened longitudinal side edge section which is then cut into a series of separate back pocket blanks. At the facility of the pants manufacturer, piece work employees then manipulate each back pocket blank by first folding same and then by sewing the back pocket blank within a back pocket opening of pants. It will be appreciated that any time saved by piece work employees in sewing back pocket blanks into pockets can benefit both the employee and the pants manufacturer since output would be increased. As a result, this would increase the hourly earnings of piece work employees while greater manufacturing output can be enjoyed by the pants manufacturer.

As will be seen from the discussion that follows, the present invention meets the foregoing objects in a new and improved method and back pocket blank which has not heretofore been contemplated by the prior art.

SUMMARY OF THE INVENTION

Among the several objects and advantages of the present invention include:

A new and improved method for manufacturing a back pocket blank for pants as well as a new and improved back pocket blank itself;

The provision of the aforementioned new and improved method and back pocket blank which greatly facilitates handling and sewing operations by piece work employees, thus improving overall production;

The provision of the aforementioned new and improved method and back pocket blank which does not in any way interfere with current sewing operations of piece work employees, but rather, complements and enhances employee work performance and efficiency as reflected in the work output of piece work employees;

The provision of the aforementioned new and improved method and back pocket blank which does not substantially increase overall costs of the back pocket blank manufacturer;

The provision of the aforementioned new and improved method and back pocket blank which can be readily adapted, changed and implemented in current manufacturing operations; and The provision of the aforementioned new and improved method and back pocket blank which eliminates some of the steps currently being performed by piece work employees in sewing pants pockets into pants by providing a simple and easy-to-handle back pocket blank that can be quickly sewn within a back pocket opening of pants.

Briefly stated, the method of forming a back pocket blank for attachment to pants within a back pocket opening includes the steps of: forming an elongated generally rectangular shaped back pocket blank having an opposed pair of longitudinal side edge portions and an opposed pair of shorter end edge portions extending generally transverse to the elongated side edge portions. A predetermined area of each of the longitudinal side edge portions are longitudinally folded back upon itself to provide a longitudinal side edge fold on each side of the back pocket blank. At the same time or shortly after the aforementioned longitudinal folding operation, each longitudinal side edge fold is creased to provide a flattened longitudinal side edge folded over section on each side of the back pocket blank. Subsequently, a predetermined area of the entire back pocket blank is folded back upon itself along a transverse fold in order to provide a transversely folded over area and a non-folded over area of the back pocket blank. The transverse folding leaves a shorter end edge portion of the transversely folded over area spaced from the shorter end edge portion of the non-folded area while positioning the flattened longitudinal side edge folded over sections of the transversely folded and non-folded areas in superimposed relationship to one another. Finally, at or shortly after the aforementioned transverse folding operation, the transverse fold is creased to maintain the transversely folded over area in superimposed proximity to the non-folded over area of the back pocket blank.

The method may also include the step of at least temporarily securing a small area of each of the superimposed flattened longitudinal side edge sections on each side of the back pocket blank in order to maintain the longitudinally and transversely folded areas of the back pocket blank in their respective folded positions prior to attachment within the pocket opening of the pants. Preferably, the aforementioned temporary securing of the superimposed flattened longitudinal side edge sections is performed adjacent to or in proximity to the transverse fold in the back pocket blank.

The temporary securing may be accomplished by a number of different methods including adhesive attachment, fusing attachment, sonic attachment or sewing attachment. In any event, temporary securing is compatible with subsequent garment making operations in order to enable the spaced shorter end edge portions of the back pocket blank to be attached to opposite marginal areas of the pants within the back pocket opening.

The back pocket blank for attachment to pants within a back pocket opening includes a generally rectangular shaped back pocket blank having an opposed pair of longitudinal side edge portions and an opposed pair of shorter end edge portions extending generally transverse to the longitudinal side edge portions. A predetermined area of each of the longitudinal side edge portions are longitudinally folded back upon itself and creased to provide a flattened longitudinal side edge folded over section on each side of the back pocket blank. A predetermined area of the entire back pocket blank is then transversely folded back upon itself along a transverse fold to provide a transversely folded over area in a non-folded area of the back pocket blank. The shorter end edge portions of the transversely folded over area and non-folded area being in superimposed relationship to one another. The transverse fold is creased to maintain the transversely folded over area in superimposed proximity to the non-folded area of the back pocket blank.

A small area of each of the superimposed flattened longitudinal side edge sections on each side of the back pocket blank are at least temporarily secured by attachment to one another in order to maintain the longitudinally and transversely folded areas of the back pocket blank in their respective folded positions prior to attachment within the back opening of the pants. Such small area is preferably located adjacent the transverse fold in each back pocket blank.

Adhesive, fusing, sonic welding or sewing can be used to temporarily secure superimposed flattened longitudinal side edge sections to one another.

These and other objects and advantages of the present invention will become apparent from the description that follows.

Corresponding reference numerals will be used throughout the several figures of the drawings.

DESCRIPTION OF THE PREFERRED EMBODIMENTS

The following detailed description illustrates the invention by way of example and not by way of limitation. The description will clearly enable one skilled in the art to make and use the invention, and describes several embodiments, adaptions, variations, alternatives and uses of the invention, including what I presently believe is the best mode of carrying out the invention.

Figure 1:
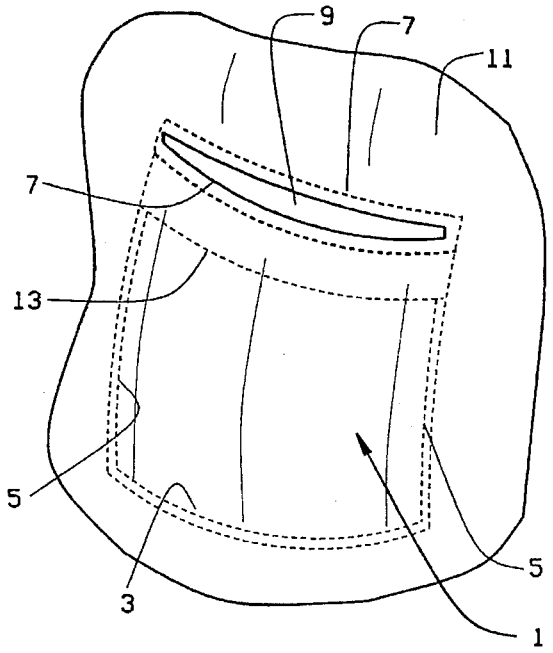
FIG. 1 is a fragmentary perspective view of a typical back pocket opening in a pair of pants with a back pocket sewn to the pair of pants on opposite sides of the back pocket opening.
Figure 2:
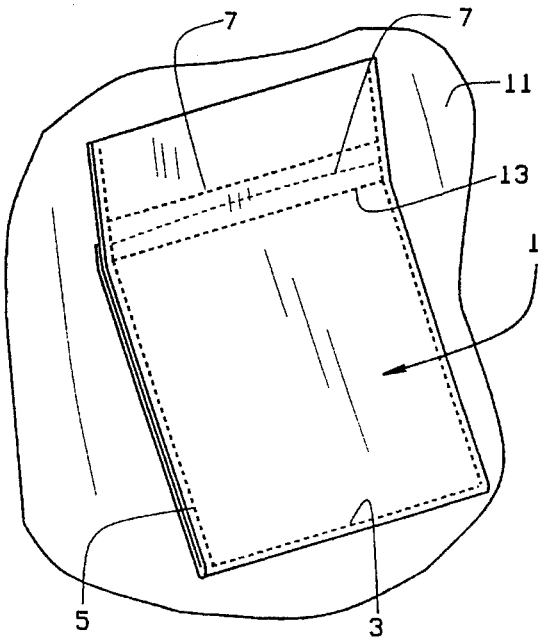
FIG. 2 is a fragmentary rear perspective view of a back pocket sewn on the inside of a pair of pants and illustrating the general construction of a back pocket and the manner in which it is attached to a pair of pants on opposite sides of a back pocket opening.

As illustrated in FIGS. 1–2 of the drawings, a typical back pocket 1 is illustrated as being folded over and sewn along a bottom edge 3 and side edge portions 5, 5, as well as being sewn along opposite sides 7, 7 of a back pocket opening 9 in a pair of pants 11. The sewing of the back pocket 1 along opposite side 7, 7 of the back pocket opening 9 thus aligns an upwardly extending opening (not shown) in the back pocket 1 for the carrying of useful objects and articles, as is well known. The back pocket blank 1, in addition to being sewn along upper line 7, is also sewn along the sew line 13 to a separate part or section (not shown) attached to the pants 11 in order to secure the pocket 1 to the pants 11. In this regard, it will also be appreciated that a part of the material along the lower edge 7 of the back pocket opening 9 is folded over an upper edge portion of the back pocket 1 along the lower line 7, also for securing the back pocket 1 to the pants 11.

Figure 3:
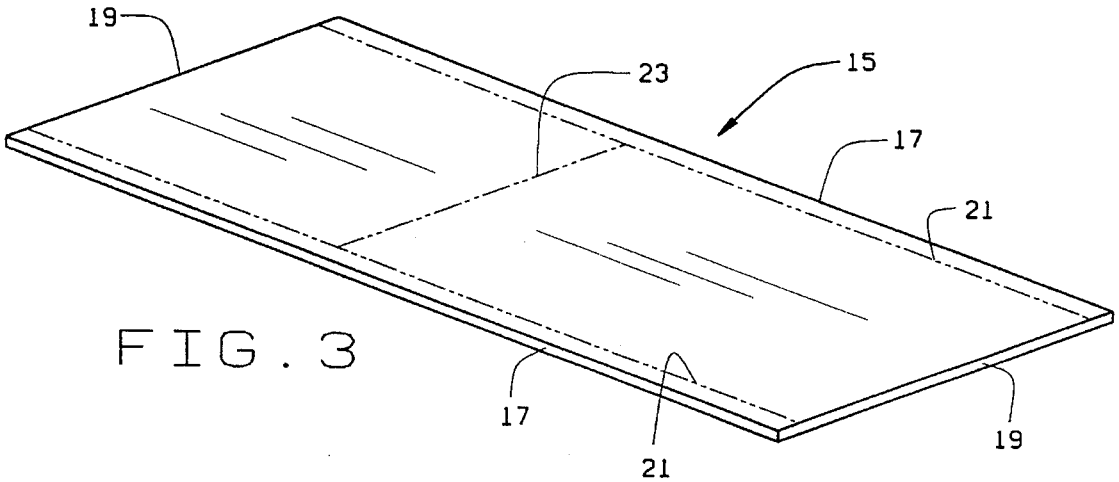
FIG. 3 is a perspective view of a back pocket blank in its pre-folded state, but illustrating through the phantom fold lines where predetermined areas of the back pocket blank are folded and creased in accordance with the present invention.

The present invention is directed to a new and improved method for manufacturing an improved back pocket blank for pants as well as to the back pocket blank itself. FIG. 3 illustrates a typical back pocket blank configuration shown to be generally rectangular shaped. The generally rectangular shaped back pocket blank 15 includes an opposed pair of longitudinal side edge portions 17, 17 and an opposed pair of shorter end edge portions 19, 19 extending generally transversely to the longitudinal side edge portions. The dotted or phantom lines illustrated in FIG. 3 represent the areas of the back pocket blank 15 that are folded and creased relative to one another, in accordance with the teachings of the present invention. Specifically, a pair of generally parallel longitudinal lines 21, 21 are parallel to each other and to the longitudinally extending side edge portions 17, 17. The back pocket blank 15 is folded over along the longitudinal fold lines 21, 21 in the manner illustrated in FIG. 4 of the drawings. In addition, a transverse fold 23 extends transversely to the longitudinal fold lines 21, 21 in an area that is offset from an imaginary transverse center line (not shown) of the back pocket blank 15 in order to produce a transversely folded back pocket blank 15, as illustrated in FIG. 5 of the drawings. In both 5–6 of the drawings, the transversely folded over back pocket blank 15 leaves the shorter end edge portion 19 of the transversely folded over area spaced from the shorter end edge portion 19 of the non-folded area, in order to produce a back pocket blank 1 that can be sewn along opposite edges of a back pocket opening 9, as described above in connection with FIGS. 1–2 of the drawings.

Figure 4:
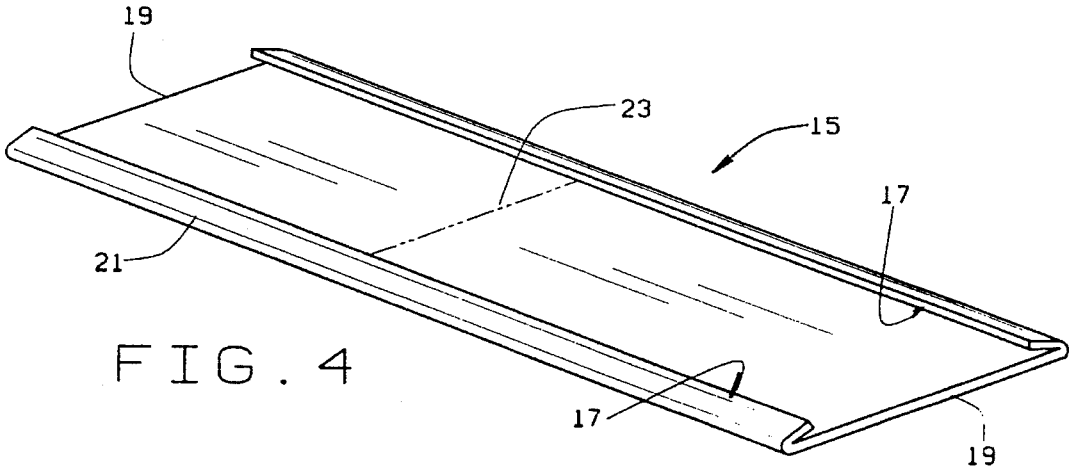
FIG. 4 is a perspective view of the back pocket blank illustrating the longitudinal folding of predetermined areas of longitudinal side edge portions back upon themselves.
Figure 5:
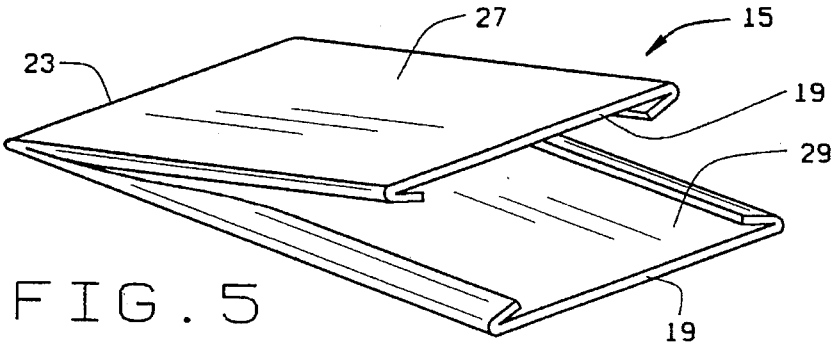
FIG. 5 is a perspective view illustrating both the longitudinal and transverse folding of the back pocket blank.
Figure 7:
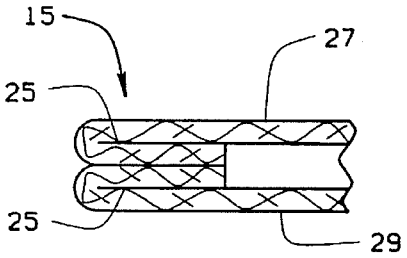
FIG. 7 is a sectional view of the folded and creased back pocket blank as viewed along lines 7—7 of FIG. 6.

When the back pocket blank 15 is folded along the longitudinally extending lines 21, 21, as illustrated in FIG. 4, and then creased along the longitudinally extending lines 21, 21, as illustrated in FIG. 7 of the drawings, a pair of flattened longitudinal side edge folded over sections 25, 25 will extend along each side of the back pocket blank 15.

At the present time, specialized pocket manufacturers supply back pocket blanks which are longitudinally folded over and creased in the manner described above for shipment to pants manufacturers. At the facility of the pants manufacturer, piece work employees take the thus formed back pocket blank and then transversely fold and sew same along the lower edge sew line 3 and side sew edge lines 5, 5 prior to attachment to a pair of pants 11 in the manner described above in connection with FIGS. 1–2 of the drawings.

While this commonly used technique is quite acceptable, it has been discovered that by providing a transversely folded and creased area, generally along the transverse fold line 23, it will produce a transversely folded over area 27 which extends over a substantial part but not all of the non-folded area 29 of the back pocket blank, leaving the shorter end edge portion 19 of the transversely folded over area 27 spaced from the shorter end edge portion 19 of the non-folded area 29, as is required for the typical sewing operation that is used in sewing the back pocket to a pair of pants.

Figure 6:
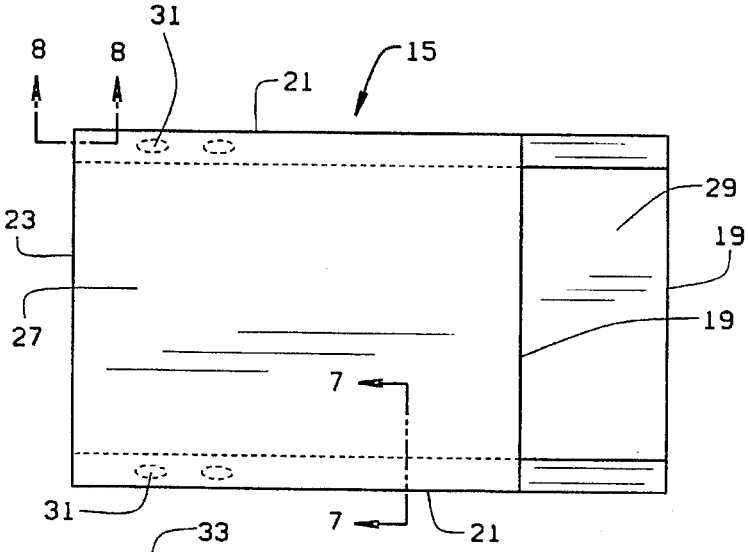
FIG. 6 is a top plan view of the back pocket blank illustrating in dotted lines one method of temporarily securing superimposed flattened longitudinal side edge folded over sections relative to one another.

When the back pocket blank 15 is transversely folded along the transverse fold line 23 to produce the transversely folded over area 27 and the non-folded area 29 as shown in FIGS. 6 and 7 of the drawings, it will also position the flattened longitudinal side edge folded over sections 25, 25 of the transversely folded over area 27 and the non-folded area 29 in superimposed relationship to one another. The further creasing of the back pocket blank 15 along the transverse fold line 23 will also cause the superimposed flattened longitudinal side edge folded over sections 25, 25 of the transversely folded over area 27 and non-folded area 29 to be maintained in juxtaposition relative to one another during normal shipping and handling. It will also eliminate a folding operation by the piece working employees of the pant manufacturer since the back pocket blank 15 will already have been folded in the desired manner, prior to stitching of same to form the back pocket and the subsequent stitching to a pair of pants.

Figure 9:
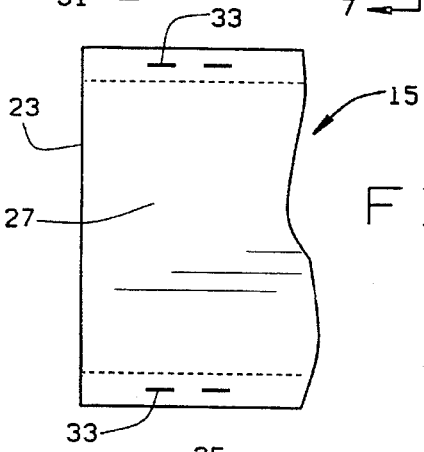
FIG. 9 is a fragmentary top plan view illustrating a second method for temporarily securing superimposed flattened longitudinal side edge folded over sections relative to one another.
Figure 10:
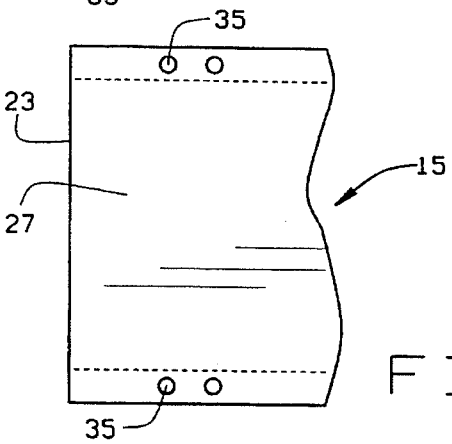
FIG. 10 is a fragmentary top plan view illustrating still another method of at least temporarily securing the superimposed flattened longitudinal side edge folded over sections relative to one another.
Figure 8:
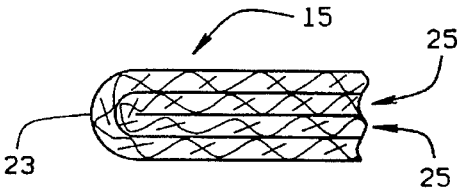
FIG. 8 is an enlarged fragmentary sectional view illustrating the superimposed flattened longitudinal side edge folded over sections of the back pocket blank as viewed along lines 8—8 of FIG. 6.

In some instances, it may be desirable to provide additional attachment of the superimposed flattened longitudinal side edge folded over sections 25, 25 of the transversely folded over area 27 and the non-folded area 29. In this regard, FIG. 6 shows the use of an adhesive 31 which can be used to secure the superimposed flattened longitudinal side edge folded over sections 25, 25 to one another. The adhesive may be applied in a single location or, as shown, a plurality of spaced locations, preferably adjacent the transverse fold line 23 of the back pocket blank 15. Other techniques for at least temporarily securing the superimposed flattened side edge folded over sections 25, 25 to each other include one or more sewn areas 33 on opposite sides of the back pocket blank 15 as shown in FIG. 9 or a fusing or sonic attachment or weld 35 as shown in FIG. 10 of the drawings.

Whatever the method employed for securing the superimposed flattened longitudinal side edge folded over sections 25, 25 relative to one another, it is only necessary that at least a temporary securement is accomplished that is sufficient to withstand normal packing, shipping and sewing room handling. Further, such selected securing techniques must also be compatible with subsequent garment making operations, as will be appreciated. Thus, the attachment technique chosen will, in part, be dependent upon compatibility with subsequent garment making operations.

From the foregoing, it will now be appreciated that the method for manufacturing an improved back pocket blank and the back pocket blank itself provides a simple and inexpensive way of providing a back pocket blank to a piece work employee which will facilitate the manufacture of a back pocket and its subsequent attachment to pants.

In view of the above, it will be seen that the several objects and features of this invention are achieved and other advantageous results obtained. As various changes could be made in the above methods and construction without departing from the scope of the invention, it is intended that all matter contained in the above description or shown in the accompanying drawings shall be interpreted as illustrative and not in a limiting sense.

I claim:

1. The method of forming a back pocket blank for attachment to pants within a back pocket opening, comprising the steps of:

forming an elongated generally rectangular shaped back pocket blank having an opposed pair of longitudinal side edge portions and an opposed pair of shorter end edge portions extending generally transverse to the longitudinal side edge portions;

longitudinally folding a predetermined area of each of the longitudinal side edge portions back upon itself to provide a longitudinal side edge fold on each side of the back pocket blank;

creasing each longitudinal side edge fold to provide a flattened longitudinal side edge folded over section on each side of the back pocket blank;

transversely folding a predetermined area of the entire back pocket blank back upon itself along a transverse fold to provide a transversely folded over area and a non-folded area of the back pocket blank, said transverse folding leaving the shorter end edge portion of the transversely folded over area spaced from the shorter end edge portion of the non-folded area while positioning the flattened longitudinal side edge folded over sections of the transversely folded over and non-folded areas in superimposed relationship to one another;

creasing the transverse fold to maintain the transversely folded over area in superimposed proximity to the non-folded over area of back pocket blank; and subsequently sewing the thus formed back pocket blank with a back pocket opening of pants.

2. The method as defined in claim 1 including the step of at least temporarily securing a small area of each of the superimposed flattened longitudinal side edge folded over sections on each side of the back pocket blank prior to sewing the back pocket blank within a pocket opening of pants in order to maintain the longitudinally and transversely folded over areas of said back pocket blank in their respective folded over positions prior to attachment within the pocket opening of the pants.

3. The method as defined in claim 2 wherein the step of temporarily securing further includes the step of performing the securing adjacent the transverse fold in said back pocket blank.

4. The method as defined in claim 3 wherein the step of temporarily securing includes the step of adhering said small areas.

5. The method as defined in claim 3 wherein the step of temporarily securing includes the step of fusing said small areas.

6. The method as defined in claim 3 wherein the step of temporarily securing includes the step of sonically attaching said small areas.

7. The method as defined in claim 3 wherein the step of temporarily securing includes the step of sewing said small areas.

8. The method as defined in claim 2 including the step of attaching the spaced shorter end edge portions of the back pocket blank to opposite marginal areas of the pants within the back pocket opening.

9. A back pocket blank for attachment to pants within a back pocket opening, comprising:

a generally rectangularly shaped back pocket blank having an opposed pair of longitudinal side edge portions and an opposed pair of shorter end edge portions extending generally transverse to the longitudinal side edge portions;

a predetermined area of each of the longitudinal side edge portions being longitudinally folded back upon itself and creased to provide a flattened longitudinal side edge folded over section on each side of the back pocket blank;

a predetermined area of the entire back pocket blank being transversely folded back upon itself along a transverse fold to provide a transversely folded over area and a non-folded area of the back pocket blank, the shorter end edge portions of the transversely folded over area and non-transversely folded area being spaced from one another, the flattened longitudinal side edge folded over sections of the transversely folded over and non-folded areas being in superimposed relationship relative to one another;

the transverse fold being creased to maintain the transversely folded over area in superimposed proximity to the non-folded area of the back pocket blank; and the thus formed back pocket blank for being subsequently sewn within a back pocket opening of pants.

10. The back pocket blank as defined in claim 9 wherein a small area of each of the superimposed flattened longitudinal side edge portions on each side of the back pocket blank is at least temporarily secured by attachment to one another prior to sewing the back pocket blank within a back pocket opening of pants in order to maintain the longitudinally and transversely folded areas of the back pocket blank in their respective folded positions prior to attachment within the back pocket opening of pants.

11. The back pocket blank as defined in claim 10 wherein the small area of each of the superimposed flattened longitudinal side edge portions is located adjacent the transverse fold in said back pocket blank.

12. The back pocket blank as defined in claim 10 wherein the small area of each of the superimposed flattened longitudinal side edge sections is at least temporarily secured together by an adhesive.

13. The back pocket blank as defined in claim 10 wherein the small area of each of the superimposed flattened longitudinal side edge sections is at least temporarily secured together by fusing.

14. The back pocket blank as defined in claim 10 wherein the small area of each of the superimposed flattened longitudinal side edge sections is at least temporarily secured together by sonic welding.

15. The back pocket blank as defined in claim 10 wherein the small area of each of the superimposed flattened longitudinal side edge sections is at least temporarily secured together by sewing.

* * * * *